US005634989A

United States Patent [19]

Hashimoto et al.

[11] Patent Number: 5,634,989

[45] Date of Patent: Jun. 3, 1997

[54] AMORPHOUS NICKEL ALLOY HAVING HIGH CORROSION RESISTANCE

[75] Inventors: Koji Hashimoto, Izumi; Akira Mitsuhashi, Omiya; Katsuhiko Asami; Asahi Kawashima, both of Sendai; Yoshio Takizawa, Omiya, all of Japan

[73] Assignees: Mitsubishi Materials Corporation, Tokyo; Koji Hashimoto, Izumi, both of Japan

[21] Appl. No.: 914,027

[22] Filed: Jul. 15, 1992

Related U.S. Application Data

[63] Continuation of Ser. No. 339,611, Feb. 24, 1989, abandoned.

[30] Foreign Application Priority Data

| | | | |
|---|---|---|---|
| May 7, 1987 | [JP] | Japan | 62-111465 |
| May 7, 1987 | [JP] | Japan | 62-111466 |
| May 7, 1987 | [JP] | Japan | 62-111467 |
| May 11, 1987 | [JP] | Japan | 62-113939 |
| May 26, 1987 | [JP] | Japan | 62-129286 |
| May 29, 1987 | [JP] | Japan | 62-134367 |
| May 29, 1987 | [JP] | Japan | 62-134368 |

[51] Int. Cl.[6] ..... C22C 19/05; C22C 27/02

[52] U.S. Cl. ..... 148/403

[58] Field of Search ..... 148/403, 304

[56] References Cited

U.S. PATENT DOCUMENTS

| | | | |
|---|---|---|---|
| 4,133,681 | 1/1979 | Ray . | |
| 4,410,490 | 10/1983 | Ray et al. . | |
| 4,496,635 | 1/1985 | Wang et al. . | |
| 4,854,980 | 8/1989 | Raman et al. | 148/403 |
| 4,968,363 | 11/1990 | Hashimoto et al. | 148/403 |

FOREIGN PATENT DOCUMENTS

| | | |
|---|---|---|
| 0224724 | 6/1987 | European Pat. Off. . |
| 3608656 | 9/1986 | Germany . |
| 53-57120 | 5/1978 | Japan . |
| 54-142122 | 11/1979 | Japan . |
| 54-142123 | 11/1979 | Japan . |
| 55-125248 | 9/1980 | Japan . |
| 61-210143 | 9/1986 | Japan . |
| 62-33735 | 2/1987 | Japan . |
| 62-33736 | 2/1987 | Japan . |
| 63-79930 | 4/1988 | Japan . |
| 63-79931 | 4/1988 | Japan . |

OTHER PUBLICATIONS

Corrosion Science, vol. 27, No. 9, pp. 957–970, 1987 "The Corrosion Behavior of Amorphous Nickel Base Alloys in a Hot Concentrated Phosphoric Acid".

*Primary Examiner*—David A. Simmons
*Assistant Examiner*—Margery S. Phipps
*Attorney, Agent, or Firm*—Cushman, Darby & Cushman IP Group of Pillsbury Madison & Sutro LLP

[57] ABSTRACT

A corrosion-resistant amorphous alloy containing Ta in an amount of from 10 to 40 atomic % and Mo, Cr, W, P, B and/or Si is disclosed.

This alloy can be prepared by rapidly cooling and solidifying molten alloy, shows a satisfactory corrosion resistance in high-temperature concentrated phosphoric acid, and is adapted to be used as a plant structural material or a separator for a fuel cell.

4 Claims, 1 Drawing Sheet

AMORPHOUS NICKEL ALLOY HAVING HIGH CORROSION RESISTANCE

This is a continuation of application Ser. No. 07/339,611, filed on Feb. 24, 1989, which was abandoned.

FIELD OF THE INVENTION

The present invention relates to an amorphous nickel alloy having a high corrosion resistance, which is suitable as a corrosion-resistant material in a severe corrosive environment such as high-temperature concentrated phosphoric acid.

BACKGROUND OF THE INVENTION

As structural materials for a high-temperature concentrated phosphoric acid plant, 309, 310 and 446 Mo stainless steels and Cr—Mo—Ti steel are popularly in use at present. Even these materials are not provided with a corrosion resistance sufficient to withstand a severe corrosive environment such as high-temperature concentrated phosphoric acid.

The present inventors have previously found amorphous nickel alloys highly resistant to pit corrosion, interstitial corrosion and uniform corrosion, and applied for patent under Japanese Patent Provisional Application No. 53-57,120, Japanese Patent Provisional Application No. 61-210,143, Japanese Patent Provisional Application No. 62-33,735, and Japanese Patent Provisional Application No. 62-33,736.

Furthermore, the present inventors have continued their studies while examining various properties of amorphous alloys, and found availability of an amorphous nickel alloy having a high corrosion resistance through formation of a stable protecting film even in a severe corrosive acid poor in oxidizing ability such as hightemperature concentrated phosphoric acid, on which they have applied for patent under Japanese Patent Applications Nos. 61-225,435 and 61-225,436.

Japanese Patent Application No. 61-225,435 covers the following four claims:

(1) An amorphous nickel alloy having a high corrosion resistance, which comprises Mo in an amount of from 10 to 30 atomic %, P in an amount of from 15 to 23 atomic %, and the balance essentially Ni.

(2) An amorphous nickel alloy having a high corrosion resistance, which comprises Mo in an amount of from 10 to 30 atomic %, one or more of B and Si in an amount of up to 7 atomic % and in a total amount with P of from 15 to 23 atomic %, and the balance essentially Ni.

(3) An amorphous nickel alloy having a high corrosion resistance, which comprises Mo in an amount of from 10 to 30 atomic %, Cr in an amount of from 30 to 40 atomic %, P in an amount of from 3 to 20 atomic %, and the balance essentially Ni.

(4) An amorphous nickel alloy having a high corrosion resistance, which comprises Mo in an amount of from 10 to 30 atomic %, Cr in an amount of from 30 to 40 atomic %, one or more of B and Si in an amount of 7 atomic % and in a total amount with P of from 8 to 20 atomic %, and the balance essentially Ni.

Japanese Patent Application No. 61-225,436 covers the following seven claims:

(1) An amorphous nickel alloy having a high corrosion resistance, which comprises Ta in an amount of from 20 to 60 atomic %, and the balance essentially Ni.

(2) An amorphous nickel alloy having a high corrosion resistance, which comprises Ta in an amount of from. 1 to 25 atomic %, P in an amount of from 15 to 23 atomic %, and the balance essentially Ni.

(3) An amorphous nickel alloy having a high corrosion resistance, which comprises Ta in an amount of from 1 to 25 atomic %, one or more of B and Si in an amount of up to 7 atomic % and in a total amount with P of from 15 to 23 atomic %, and the balance essentially Ni.

(4) An amorphous nickel alloy having a high corrosion resistance, which comprises Cr in an amount of from 10 to 40 atomic %, P in an amount of from 15 to 23 atomic %, and the balance essentially Ni.

(5) An amorphous nickel alloy having a high corrosion resistance, which comprises Cr in an amount of from 10 to 40 atomic %, one or more of B and Si in an amount of up to 7 atomic % and a total amount with P of from 15 to 23 atomic %, and the balance essentially Ni.

(6) An amorphous nickel alloy having a high corrosion resistance, which comprises Ta in an amount of up to 20 atomic % and in a total amount with Cr of from 10 to 40 atomic %, P in an amount of from 15 to 23 atomic and the balance essentially Ni.

(7) An amorphous nickel alloy having a high corrosion resistance, which comprises Ta in an amount of up to 20 atomic % and a total amount with Cr of from 10 to 40 atomic %, one or more of B and Si in an amount of up to 7 atomic % and a total amount with P of from 15 to 23 atomic %, and the balance essentially Ni.

Because of the high boiling point, concentrated phosphoric acid is particularly corrosive at high temperatures, so that there is available no metal material which can be safely used. The alloys disclosed in the above-mentioned Japanese Patent Applications No. 61-225,435 and No. 61-225,436 show a high corrosion resistance even in such an environment. There is however an increasing demand for development of further various metal materials capable of withstanding such a corrosive environment where it is very difficult to use usual metal materials.

DISCLOSURE OF THE INVENTION

An object of the present invention is therefore to provide an alloy capable of withstanding an environment which hardly passivates a metal, being non-oxidizing, and exhibits a very severe corrosivity such as high-temperature concentrated phosphoric acid.

An alloy is usually in the form of crystals in its solid state. However, when a method of not allowing formation of a long-period regularity to the atomic arrangement during formation of solid, through, for example, extra-rapid cooling for solidification from the molten state by limiting the chemical composition of an alloy, an amorphous structure similar to liquid is obtained, and the thus obtained alloy is called an amorphous alloy. In most cases, an amorphous alloy is a uniform singlephase alloy of a super-saturated solid-solution. It has a far higher strength as compared with conventional commercial metals, and shows various properties, depending upon the chemical composition, including an abnormally high corrosion resistance. The present inventors carried out studies on utilization of properties of such amorphous alloys, and found as a result an amorphous nickel-base alloy having a high corrosion resistance not susceptible to pit corrosion, interstitial corrosion or uniform corrosion even in very corrosive aqueous solution such as aqueous solution containing a strong acid or high-concentration chlorine ions, and have applied for patent under Japanese Patent Provisional Application No. 53-57,120. In addition, the present inventors found another amorphous alloy having a high corrosion resistance applicable in a severe corrosive environment such as that containing boiling concentrated nitric acid or additionally containing an oxidizer, and applied for patent under Japanese Patent Provisional Application No. 61-21,043. They found another amorphous alloy having a high corrosion resistance applicable in a severely corrosive environment such as boiling concentrated chlorine, and applied for patent under Japanese Patent Provisional Applications Nos. 62-33,735 and 62-33,736. All these are amorphous nickel alloys. Because of the high boiling point, concentrated phosphoric acid is particularly corrosive at high temperatures, as described above, and a sufficient corrosion resistance is not obtained unless the alloy itself has the ability to form a stable protecting film.

The present inventors carried out further studies while examining the various properties of amorphous alloys. As a result, they found availability of new amorphous nickel alloys provided with a high corrosion resistance through formation of a stable protecting film even in a severe corrosive acid poor in oxidizing ability such as high-temperature concentrated phosphoric acid, in addition to the alloys disclosed in the aforementioned Japanese Patent Provisional Applications Nos. 53-57,120, 61-210,143, 62-33,735, and 62-33,736, and applied for patent under Japanese Patent Application No. 61-225,435 and Japanese Patent Application No. 61-225,436.

Moreover, the present inventors further continued their studies on corrosion resistance of amorphous alloys, and as a result, achieved the present invention by founding out availability of amorphous nickel alloys showing a high corrosion resistance even in high-temperature concentrated phosphoric acid through combination of various elements in addition to the alloys disclosed in the above-mentioned Japanese Patent Application No. 61-225,435 and Japanese Patent Application No. 61-225,436.

The present invention consists of Claims 1 to 7, the component elements and their contents of which are shown in Table 1.

formly dissolved. A very uniform protecting film which ensures a high corrosion resistance is therefore produced on any of the amorphous nickel alloys of the present invention.

A metal material easily melts in high-temperature concentrated phosphoric acid solution poor in oxidizing ability. In order to use a metal material in such an environment, therefore, it is necessary to impart the ability to produce a stable protecting film to the metal material. This is accomplished by preparing an alloy containing effective elements in required amounts. In the case of a crystalline metal, however, addition of diverse alloy elements in large quantities often results in a multiple-phase structure comprising different chemical properties, and a desired corrosion resistance cannot be achieved. Generation of chemical non-uniformity is detrimental to corrosion resistance.

In contrast, the amorphous alloy of the present invention is a uniform solid-solution and uniformly contains effective elements in required amounts capable of forming a stable protecting film. A uniform protecting film is produced and gives a sufficiently high corrosion resistance in such an amorphous nickel alloy, More particularly, the condition to be satisfied by a metal material to withstand high-temperature concentrated phosphoric acid poor in oxidizing power is to have a high ability to form a stable protecting film to be uniformly produced on the material in a non-oxidizing environment. This is achieved by means of the chemical compositions of the alloys of the present invention, and the fact that an alloy has an amorphous structure permits preparation of an alloy with a complicated chemical composition into a single-phase solid-solution and ensures formation of a uniform protecting film.

Now, the reasons of limiting the chemical composition in the present invention are described below.

Ni is an element forming the basis of the alloys of the present invention, which forms an amorphous structure in the presence of at least one of Mo and Cr in a prescribed total amount with Ta, and forms an amorphous structure also in the presence of P. Ni assists the effects of Ta, Mo, Cr and W responsible for corrosion resistance.

TABLE 1

| Claim No. | Chemical composition (atomic %) of alloys of the present invention | | | | | | |
|---|---|---|---|---|---|---|---|
| | Ta | Mo | Cr | Mo. Cr | Mo. W | P | Ni(*1) |
| 1 | 10–40 | 25–50(*2) | | | | | Balance |
| 2 | at least 10, up to 25 | | 25–50(*2) | | | | Balance |
| 3 | 10–40 | | | 25–50(*3) | | | Balance |
| 4 | 10–40 | 25–50(*2) | | | | Under 10 | Balance |
| 5 | 10–40 | | | 25–50(*3) | | Under 10 | Balance |
| 6 | at least 1 | | | | 15–30(*4) | 10–23(*6) | Balance |
| 7 | | | | | 15–30(*5) | 10–23(*6) | Balance |

(*1) Essentially Ni
(*2) Total amount with Ta
(*3) Total amount of Mo, Cr and Ta
(*4) Total amount of at least one of Mo and W, with Ta
(*5) Total amount of Mo in an amount of at least 3 atomic % with W
(*6) Total amount of one or more of B and Si, with P, provided that the total amount of one or more of B and Si is up to 7 atomic %.

The amorphous alloys available by various methods for preparing amorphous alloys through extra-rapid cooling and solidification of molten alloys of the above-mentioned chemical compositions or sputter deposition thereof are single-phase alloys in which the above elements are uni- Ta, Mo, Cr and W are elements responsible for corrosion resistance through formation of a protecting film. When the total content of Ta and any of the other elements is from 25 to 50 atomic %, a metal-metal alloy thereof with Ni can form an amorphous structure. The total content of at least one of Mo and Cr with Ta is therefore specified to be from 25 to 50 atomic % in Claims 1 to 5 of the present invention. However, to avoid duplication with the alloy disclosed in the above-mentioned Japanese Patent Provisional Application No. 62-33,735 in the case of an alloy not containing Mo, the total content of Cr with Ta in an alloy containing Ta in an amount of at least 25 atomic % should be under 30 atomic %. P is an effective element which assists formation of a protecting film of Ta, Mo, Cr or W. However, because addition of P in a large amount to a metal-metal alloy makes it difficult to obtain an amorphous structure, the P content is set forth to be under 10 atomic % in Claims 4 and 5 of the present invention.

In an Ni-P alloy, on the other hand, a high content of P produces an amorphous structure as a metal-semimetal alloy. However, addition of excessive p rather hinders formation of an amorphous structure. For the purpose of producing an amorphous structure, therefore, the P content is limited within the range of from 10 to 23 atomic % in Claims 6 and 7 of the present invention. As an amorphous metal-semimetal alloy containing P in a sufficient amount as above has a high ability to form a protecting film, the alloy of Claim 6 of the present invention can have a sufficient corrosion resistance even in severely corrosive high-temperature concentrated phosphoric acid, if the total amount of at least one of Mo and W with Ta in an amount of at least 1 atomc % is at least 10 atomic %. Similarly, an amorphous metal-metal alloy can have a sufficient corrosion resistance in severely corrosive high-temperature concentrated phosphoric acid, if the total amount of W in an amount of at least 3 atomic % and W is at least 10 atomic %, as in that claimed in Claim 7 of the present invention. In the case of a metal-semimetal alloy, addition of excessive Mo, W or Ta makes it difficult to obtain an amorphous structure. The total amount of at least one of Mo and W with Ta in an amount of 1 atomic % is therefore specified to be up to 30 atomic in Claim 6 of the present invention, and the sum of Mo in an amount of at least 3 atomic % and W is set out to be up to 30 atomic % in Claim 7 of the present invention.

B and Si are elements effective for the formation of an amorphous structure in the presence of Ni and can replace P. However, in order not to reduce the effect of P of promoting formation of a protecting film, it is not desirable that P should be replaced by one or more of B and Si in a total amount of over 7 atomic %.

The amorphous nickel alloy of the present invention may contain Nb in an amount of up to 10 atomic %, and Ti and Zr in an amount of up to 5 atomic % without impairing the object of the present invention.

For the preparation of the amorphous alloy of the present invention, any of the various popularly utilized methods for preparing an amorphous alloy may be applied, including that of extra-rapidly cooling and solidifying liquid alloy, those of forming an amorphous alloy through the gaseous phase, and that of destroying the long-period structure of solid through ion injection.

An apparatus for preparing the amorphous alloy of the present invention is illustrated in FIG. 1. In FIG. 1, the portion enclosed by the dotted line is evacuated into vacuum, and then filled with inert gas. In this figure, 2 is a silica tube having a vertical nozzle 3 at the lower tip thereof, and the raw material 4 and the inert gas for preventing oxidation of the raw material 4 can be introduced through an inlet port 1 provided on the top of the silica tube 2. A heating furnace 5 is installed around the silica tube 2 to heat the above-mentioned raw material 4. A high-speed rotating roll 7 is placed vertically below the nozzle 3, and is rotated by means of a motor 6. When preparing an amorphous alloy, the raw material 4 having a prescribed chemical composition is charged in the silica tube 2, and first evacuating the apparatus to a vacuum of about $10^{-5}$ Torr, the tube is filled with inert gas.

Then, the raw material 4 is heated and melted in the heating furnace 5, and the resulting molten metal is ejected by means of compressed inert gas onto the outer peripheral surface of the roll 7 rotating at such a high speed as from 1,000 to 10,000 rpm by the action of the motor 6. Application of this method permits preparation of the amorphous alloy of the present invention as a long sheet having, for example, a thickness of 0.1 mm, a width of 10 mm, and a length of several meters.

BRIEF DESCRIPTION OF THE DRAWING

In FIG. 1, 1: raw material inlet port, 2: silica tube, 3: nozzle section, 4: raw material, 5: heating furnace, 6: motor, and 7: high-speed rotating roll.

EXAMPLE

Figure 1:
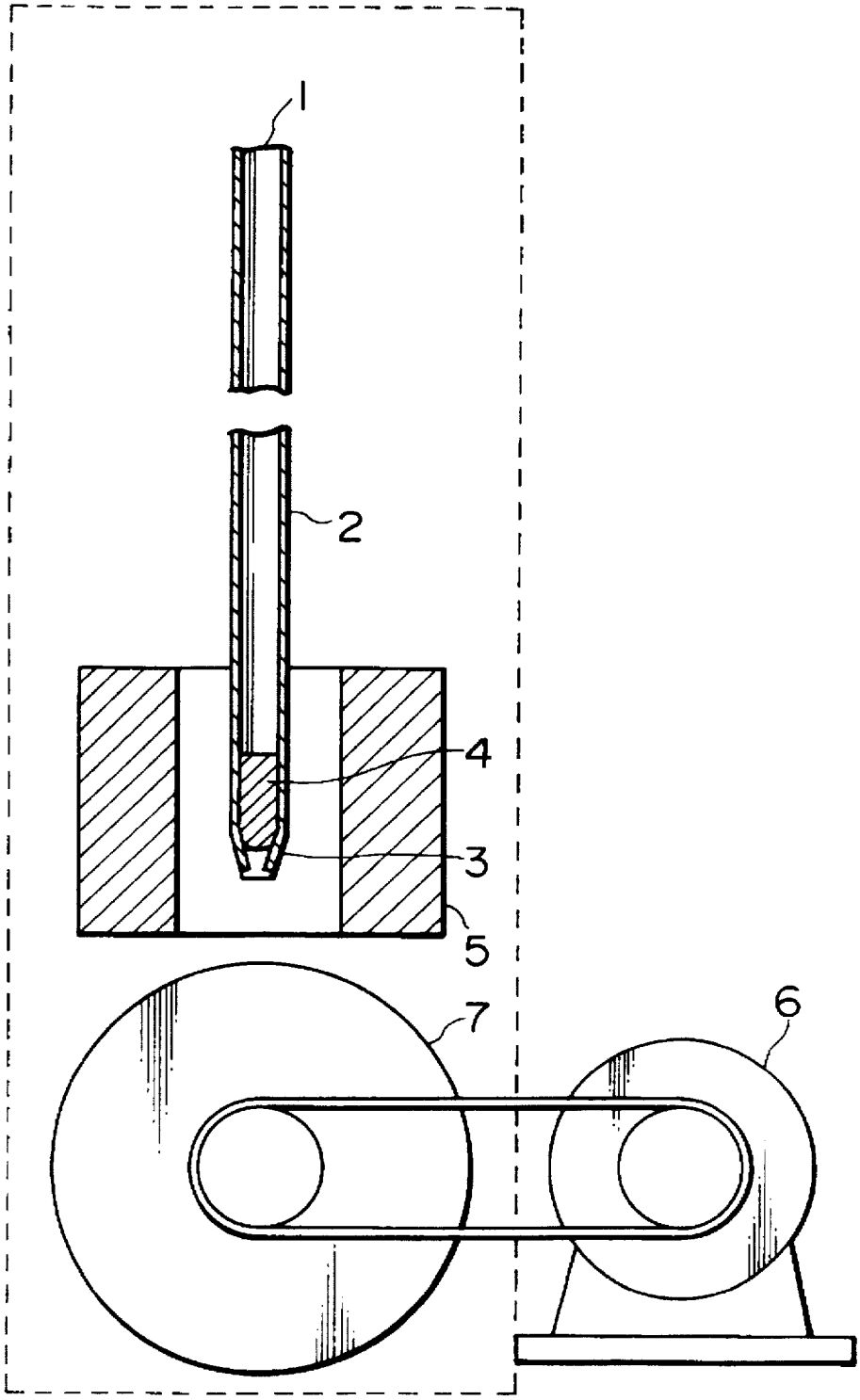
FIG. 1 is a schematic view illustrating an apparatus for the preparation of the amorphous alloy of the present invention.

Raw material metals were mixed so as to give the chemical compositions shown in Table 2, and raw material alloys were prepared in an argon arc melting furnace. These alloys were remelted in argon atmosphere, and extra-rapidly cooled and solidified by the application of the single roll method as shown in FIG. 1 into amorphous alloy sheets having a thickness of from 0.01 to 0.05 mm, a width of from 1 to 3 mm and a length of from 3 to 20 m. Formation of an amorphous structure was confirmed by means of X-ray diffraction. The surfaces of these alloy specimens were ground in cyclohexane up to silicon carbide paper No. 1000. Then alloy specimens of a prescribed length were cut, immersed in about 63% $P_2O_5$ solution at 160° C. and 72% $P_2O_5$ solution at 200° C. for a period of from 7 to 10 days, and the weight before and after immersion was measured by means of a micro-balance. The results obtained are shown in Table 3.

TABLE 2

| | | Chemical composition of alloys (atomic %) | | | | | |
|---|---|---|---|---|---|---|---|
| Claim No. | Specimen No. | Ni | Ta | Mo | Cr | W | P |
| 1 | 1 | 70 | 10 | 20 | | | |
| | 2 | 75 | 20 | 5 | | | |
| | 3 | 70 | 20 | 10 | | | |
| | 4 | 60 | 20 | 20 | | | |
| | 5 | 60 | 30 | 10 | | | |
| | 6 | 60 | 30 | 20 | | | |
| 2 | 7 | 60 | 10 | | 30 | | |
| | 8 | 60 | 20 | | 20 | | |
| | 9 | 61 | 24 | | 15 | | |
| | 10 | 56 | 24 | | 20 | | |
| 3 | 11 | 65 | 10 | 20 | 5 | | |
| | 12 | 55 | 20 | 15 | 10 | | |
| | 13 | 60 | 30 | 5 | 5 | | |
| 4 | 14 | 63 | 10 | 20 | | | 7 |
| | 15 | 62 | 20 | 10 | | | 8 |
| | 16 | 43 | 30 | 15 | | | 7 |
| | 17 | 49 | 40 | 5 | | | 6 |
| 5 | 18 | 56 | 10 | 15 | 10 | | 9 |
| | 19 | 57 | 20 | 10 | 10 | | 3 |
| | 20 | 60 | 25 | 5 | 5 | | 5 |
| 6 | 21 | 67 | 1 | 14 | | | 13 |

TABLE 2-continued

| Claim No. | Specimen No. | Chemical composition of alloys (atomic %) Ni | Ta | Mo | Cr | W | P |
|---|---|---|---|---|---|---|---|
| | 22 | 65 | 1 | 15 | | | 19 |
| | 23 | 63 | 3 | 15 | | | 19 |
| | 24 | 61 | 5 | 15 | | | 19 |
| | 25 | 60 | 20 | 10 | | | 10 |
| | 26 | 63 | 3 | | | 15 | 19 |
| | 27 | 64 | 20 | | | 5 | 11 |
| | 28 | 63 | 3 | 10 | | 5 | 19 |
| | 29 | 61 | 5 | 15 | | 14 | 14(B:5) |
| | 30 | 61 | 5 | 15 | | 15 | 15(Si:4) |
| | 31 | 61 | 5 | 15 | | 15 | 15 [B: 2, Si: 2] |
| | 32 | 64 | 8 | 16 | | 16 | 16 [B: 2, Si: 2] |
| | 33 | 62 | 3 | 16 | | 1 | 16 [B: 1, Si: 1] |
| 7 | 34 | 63 | | 3 | | 15 | 19 |
| | 35 | 66 | | 5 | | 10 | 19 |
| | 36 | 66 | | 10 | | 5 | 19 |
| | 37 | 56 | | 15 | | 10 | 24 |
| | 38 | 61 | | 17 | | 3 | 14(B:5) |
| | 39 | 63 | | 15 | | 3 | 16(Si:3) |
| | 40 | 62 | | 15 | | 3 | 16 [B: 2, Si: 2] |

TABLE 3

Examples of corroding rate (g/hm$^2$) of the alloys of the present invention in phosphoric acid solution

| Specimen No. | 63% $P_2O_5$, 160° C. | 72% $P_2O_5$, 200° C. |
|---|---|---|
| 1 | 0.0622 | 0.225 |
| 2 | 0.0331 | 0.154 |
| 3 | 0.0222 | 0.094 |
| 4 | 0.0132 | 0.146 |
| 5 | 0.0127 | 0.045 |
| 6 | 0.0133 | 0.046 |
| 7 | 0.0635 | 0.365 |
| 8 | 0.0531 | 0.122 |
| 9 | 0.0201 | 0.090 |
| 10 | 0.0192 | 0.085 |
| 11 | 0.0597 | 0.213 |
| 12 | 0.0195 | 0.136 |
| 13 | 0.0125 | 0.045 |
| 14 | 0.0355 | 0.185 |
| 15 | 0.0177 | 0.134 |
| 16 | 0.0098 | 0.035 |
| 17 | 0.0075 | 0.021 |
| 18 | 0.0347 | 0.201 |
| 19 | 0.0163 | 0.127 |
| 20 | 0.0099 | 0.035 |
| 21 | 0.0345 | 0.210 |
| 22 | 0.0303 | 0.195 |
| 23 | 0.0213 | 0.187 |
| 24 | 0.0197 | 0.173 |
| 25 | 0.0233 | 0.171 |
| 26 | 0.0670 | 0.251 |
| 27 | 0.0252 | 0.183 |
| 28 | 0.0233 | 0.195 |
| 29 | 0.0211 | 0.196 |
| 30 | 0.0208 | 0.196 |

TABLE 3-continued

Examples of corroding rate (g/hm$^2$) of the alloys of the present invention in phosphoric acid solution

| Specimen No. | 63% $P_2O_5$, 160° C. | 72% $P_2O_5$, 200° C. |
|---|---|---|
| 31 | 0.0214 | 0.187 |
| 32 | 0.0625 | 0.244 |
| 33 | 0.0230 | 0.188 |
| 34 | 0.0435 | 0.353 |
| 35 | 0.0403 | 0.282 |
| 36 | 0.0391 | 0.237 |
| 37 | 0.0353 | 0.218 |
| 38 | 0.0410 | 0.266 |
| 39 | 0.0407 | 0.281 |
| 40 | 0.0413 | 0.277 |

The corroding rate of the amorphous alloys of the present invention is very slight. As a result of analysis of the alloy surface by the application of the X-ray photoelectron spectrometry after the immersion test of the alloy of the present invention, a protecting film of hydrated oxide of concentrated Ta and Mo or hydrated oxyhydroxide was produced on the alloy, and this was found to be the cause of the high corrosion resistance of the alloy of the present invention.

INDUSTRIAL USE

The amorphous nickel alloy of the present invention is, as described above in detail, highly corrosion-resistant in that it is not corroded through formation of a stable protecting film even in a severely corrosive environment poor in oxidizing ability such as high-temperature phosphoric acid.

Since any of the popularly applied known techniques for the preparation of an amorphous alloy is applicable to the preparation of the alloy of the present invention, it is not necessary to use a special apparatus, thus providing excellent practical utility of the alloy of the present invention.

What is claimed is:

1. An amorphous nickel alloy having a high corrosion resistance, which consists of Ta in an amount of from 10 to 40 atomic %, Mo in a total amount with Ta of from 25 to 50 atomic %, with Mo in an amount of at least 3 atomic %, and the balance Ni.

2. An amorphous nickel alloy having a high corrosion resistance, which consists of Ta in an amount of from 10 to 40 atomic %, Mo in a total amount with Ta of from 25 to 50 atomic %, with Mo in an amount of at least 3 atomic %, P in an amount of from 3 to 10 atomic %, and the balance Ni.

3. An amorphous nickel alloy having a high corrosion resistance, which consists of Ta in an amount of at least 1 atomic %, at least one of Mo and W in a total amount with Ta of from 15 to 30 atomic %, with Mo in an amount of at least 3 atomic %, at least one of P, B and Si in an amount of from 10 to 23 atomic %, and the balance Ni.

4. An amorphous nickel alloy having a high corrosion resistance, which consist of Mo in an amount of at least 3 atomic %, W in a total amount with Mo of from 15 to 30 atomic %, at least one of P, B and Si in an amount of from 10 to 23 atomic %, and the balance Ni.

* * * * *

UNITED STATES PATENT AND TRADEMARK OFFICE

CERTIFICATE OF CORRECTION

PATENT NO. : 5,634,989

DATED : June 3, 1997

INVENTOR(S) : Hashimoto, et. al.

It is certified that error appears in the above-indentified patent and that said Letters Patent is hereby corrected as shown below:

Title page, item [30] Foreign Application Priority Data, insert--
May 7, 1988 [PCT] Japan..... 88-00449--.

Signed and Sealed this

Twenty-third Day of September, 1997

*Attest:*

BRUCE LEHMAN

*Attesting Officer*

*Commissioner of Patents and Trademarks*